US005466065A

United States Patent [19]

Catrombon

[11] Patent Number: 5,466,065

[45] Date of Patent: Nov. 14, 1995

[54] CONICAL MOTION MIXING MACHINE

[76] Inventor: George T. Catrombon, 103 Union Rd., Frenchtown, N.J. 08825

[21] Appl. No.: 227,205

[22] Filed: Apr. 13, 1994

[51] Int. Cl.[6] ..... B01F 9/00

[52] U.S. Cl. ..... 366/209; 366/605

[58] Field of Search ..... 366/53–55, 62, 366/63, 208, 209, 213, 215, 217, 219, 605; 74/86; 248/652

[56] References Cited

U.S. PATENT DOCUMENTS

| | | | |
|---|---|---|---|
| 761,317 | 5/1904 | McCall | 74/86 |
| 881,583 | 3/1908 | Hodgkins | 451/328 |
| 2,797,902 | 7/1957 | Beugler | 366/217 |
| 3,030,082 | 4/1962 | Matzen et al. | 366/209 |
| 3,346,241 | 10/1967 | Schubert | 366/209 |
| 3,809,322 | 5/1974 | Hirosawa | 241/46.17 |
| 4,345,843 | 8/1982 | Berglund et al. | 366/219 |
| 4,834,548 | 5/1989 | Tempel et al. | 366/208 |

*Primary Examiner*—Charles E. Cooley
*Attorney, Agent, or Firm*—Dorsey & Whitney

[57] ABSTRACT

Apparatus for mixing a medium in a vessel has structure for moving the vessel in a path defining a cone. A clamp assembly includes jaws which releasably clamp the vessel in the apparatus and prevent rotation of the vessel around its own axis. The structure includes a spherical bearing mounted at each end of the clamp assembly. A threaded shaft for moving one of the jaws is axially slidably received in one of the spherical bearings. The other spherical bearing connects a shaft extending from the other jaw at an eccentric position relative to a rotary shaft of a drive motor.

23 Claims, 4 Drawing Sheets

CONICAL MOTION MIXING MACHINE

BACKGROUND OF THE INVENTION

The present invention relates to a mixing apparatus and, more particularly, to a low cost air powered paint mixing machine.

Numerous configurations of mixing equipment are known which employ various means of motive power as well as varying mechanical motions to induce a mixing process. Among this mixing equipment are low cost mixing devices suitable for use with paints containing volatile solvents. These devices are air powered and usable in environments demanding explosion proof precautions, but they suffer from mechanical motions which are limited to one plane. The motion in these mixing devices is induced by air powered piston/cylinder arrangements which impart no lifting action to the media being mixed and, therefore, have a relatively poor mixing performance in the case of heavy solid type paints.

U.S. Pat. No. 4,834,548 to Tempel et al. discloses an agitating apparatus which employs a mixing motion about a cone having a substantially vertical axis. Although the mixing motion of this apparatus is an improvement over previous devices, the motion has the drawback that heavy solids in the package are not moved upward, since the conical motion is about a substantially vertical axis. Although this patent indicates that good vertical dispersion is achieved since radially outward flow causes a circulation from top to bottom in the package, such satisfactory vertical dispersion appears to be limited to high speeds, that is, preferably at least 1,000 rpm. Mixing apparatus operating at those speeds tends to be less safe than mixers rotating more slowly. In addition, the mixing apparatus disclosed in the Tempel et al. patent requires a stand to support the apparatus and, more specifically, a stand which will allow the drive motor for the apparatus to extend through the stand but be supported above a floor or other supporting surface. Still further, the mechanism of Tempel et al. for providing the conical motion is cumbersome and requires the point of intersection between the rotation axis and motion axis to be spaced inwardly from both the outer and inner apparatus frames.

SUMMARY OF THE INVENTION

It is an object of the present invention to provide a mixing apparatus which imparts to a vessel containing a media to be mixed a motion including a large vertical component by which the vessel and media are "lifted" and effectively mixed at relatively low speeds, and in which the lifting component varies within the media to impart shear forces between adjacent planes in the media.

It is also an object of the present invention to provide a mixing apparatus which imparts to the vessel a motion having a rotary component to induce a stirring action, as well as a component in a plane perpendicular to the plane of rotation, thus establishing the mixing apparatus as a two-plane mixer. It is a further object of the present invention to accomplish the above object in the simplest manner possible with a minimum of mechanical parts, particularly bearings.

It is also an object of the present invention to provide an improved conical motion mixing device for a fluid such as paint or the like.

In order to achieve these and other objects, a clamp assembly is provided which has a threaded shaft rotatable to releasably clamp a vessel between jaws. A motor having a rotary shaft is provided at an end of the clamp assembly opposite to the threaded shaft. The threaded shaft, which extends from a movable jaw, is mounted for sliding movement in a spherical bearing, and another shaft, which is connected to a fixed jaw, extends in an opposite direction for eccentric connection to the rotary shaft of the motor for moving the vessel in a substantially conical path. The intersection of the threaded shaft with the spherical bearing defines the fixed end of the mixing apparatus coinciding with the vertex of the cone through whose path the vessel moves. The threaded shaft cooperates with a-threaded bore provided in a cross member. The cross member is connected to guide bars, the opposite ends of which are connected to the fixed jaw. The movable jaw defines apertures receiving the guide bars on which the movable jaw slides. Rod members define a stand for supporting the apparatus, and springs are connected between the stand and the cross member to prevent rotation of the cross member about the threaded shaft. Portions of the cross member extend laterally beyond the springs to define hand grips so that the cross member may be gripped and prevented from rotating when the threaded shaft is rotated to adjust the movable jaw.

DESCRIPTION OF THE PREFERRED EMBODIMENT

Figure 1:
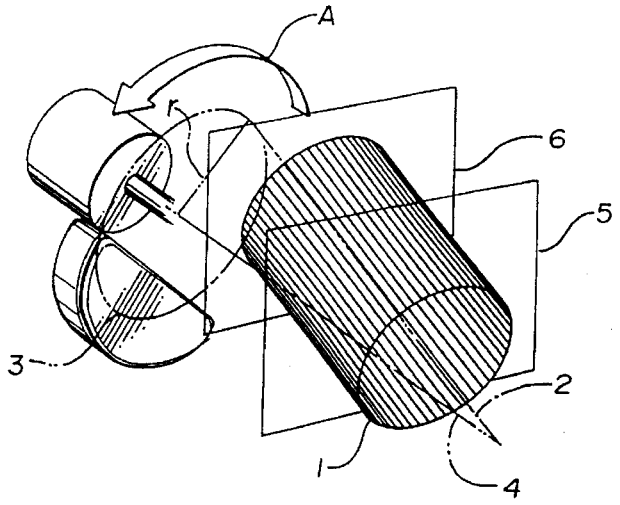
FIG. 1 is a schematic illustration in perspective of a vessel and the motion imparted to the vessel by the apparatus according to the present invention.

As can be understood from FIG. 1, the motion which is imparted to a vessel 1, such as a can of paint, is conical in nature. In this motion, the longitudinal axis of the vessel 1 is a line, called a generator line or generatrix 2, which generates the surface of a right circular cone having a base whose circumference is indicated by the dashed line 3, the base having a radius r. The generatrix 2 is fixed at its vertex end and moved along the circumference 3 of the base circle at its base end. The length of the generatrix 2 is constant in the specific case of a right circular cone with the axis 4 of the cone through the center. The fact that the length of the generatrix 2 is constant is an important factor to the smooth operation of the mixing apparatus according to the present invention. In the preferred embodiment, the axis 4 of the cone is substantially horizontal.

If the generatrix 2 is continually allowed to rotate about the axis 4 of the cone, any point on the generatrix describes a circle the radius of which is dependent on the distance of the point from the fixed or vertex end of the generatrix. All such generated circles are in planes parallel to the base plane of the cone.

When the vessel 1 is caused to move with the generatrix 2 in the direction indicated by arrow A around the horizontal axis 4 of the cone, with or without rotation of the vessel 1 about its own axis, the media contained in the vessel, such as paint, experiences shear forces, the horizontal and vertical components of which vary in amplitudes depending on the distance from the fixed end of the generatrix 2 of the portion of the media under consideration. The portion of the media lying in a first shear plane 5 shown in FIG. 1 experience shear forces of moderate amplitude and the portion of the media lying in the shear plane 6, farther from the fixed end of the generatrix 2, experience shear forces of high amplitude. These shear forces result in mixing of the media which has a component along planes perpendicular to the generatrix 2, that is, a component parallel to the shear planes.

Figure 2:
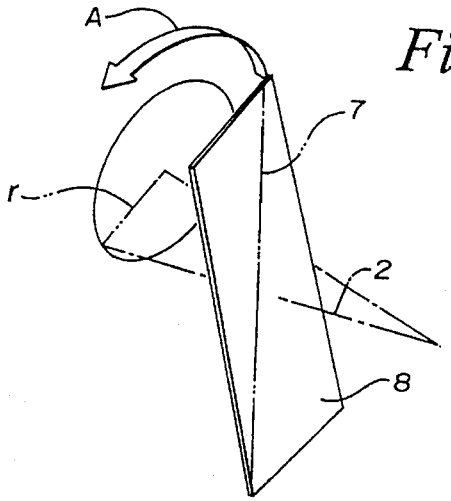
FIGS. 2 and 3 are schematic illustrations of a mixing motion component parallel to the axis of rotation of the vessel for the motion associated with the mixing apparatus according to the present invention.
Figure 3:
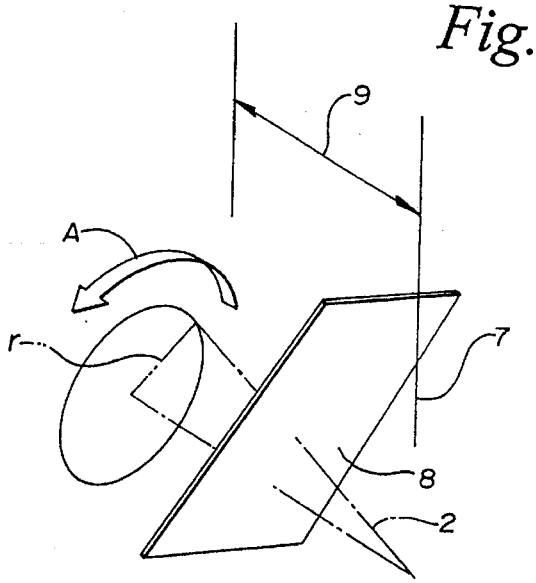

As can be appreciated from FIG. 2, a specific plane within the vessel 1 which is perpendicular to and pierced by the generatrix 2 at a given point, but restrained from rotating about the generatrix, will have its extremities moved not only in a plane parallel to the base circle of the cone but also in a third dimension substantially perpendicular to the plane. In the position A of FIG. 2, a point 7 on an extremity of a reference plane 8, which can represent, for example, a finite volume of paint in a can, also has a component of movement parallel to the axis of rotation, that is, the axis of the cone, in moving to its position shown in FIG. 3, which is 180° removed its position on FIG. 2. This component of movement is represented in FIG. 3 by the arrow 9. Thus, a three dimensional mixing of the media contained by the vessel 1 is provided.

As can best be seen from FIGS. 4–8, the mixing apparatus according to the present invention, which is designated generally by the reference numeral 10, provides a structure for imparting to a vessel, such as a can of paint, a conical motion preferably around a substantially horizontal axis while preventing rotation of the vessel about its own axis. The mixing apparatus 10 includes a fixed jaw 12 and a moveable jaw 14 secured to an end of a threaded shaft 16 such that the threaded shaft is rotatable relative to the moveable jaw 14 to move the moveable jaw 14 toward and away from the fixed jaw 12. By this arrangement, a vessel can be secured in and removed from the mixing apparatus 10. The threaded shaft 16 extends through and cooperates with a threaded bore in a nut 18 attached to a cross member 20 to provide a support against which the threaded shaft 16 can react to hold the moveable jaw 14 against the vessel. The nut 18 is secured over a bore in the cross member 20 through which the threaded shaft 16 extends. The cross member 20 is fixed to the ends of parallel guide bars 22 which are fixed at their opposite ends to the fixed jaw 12. The guide bars 22 are parallel to the generatrix of a cone through which the mixing apparatus 10 moves a vessel. The guide bars 22 are diametrically opposed with respect to the jaws 12 and 14, which are circular. The moveable jaw 14 includes a pair of opposed sleeves 24 with aperatures to receive the guide bars 22, so that the moveable jaw 14 can slide along the guide bars 22. A hand crank 26 is secured at the outboard end of the threaded shaft 16 to enable the user to tighten the vessel between the jaws 12 and 14. In a preferred embodiment, the cross member 20 extends laterally beyond the moveable jaw 14 a sufficient distance to provide a hand grip 28 at each side in order that a user may keep the cross member 20, the guide bars 22 and the jaws 12 and 14 from rotating as the hand crank 26 is rotated to tighten the moveable jaw 14 against the vessel or loosen the jaw therefrom. The jaws 12 and 14, the threaded shaft 16, the threaded member 18, the cross member 20, the guide bars 22, and the hand crank 26, along with another shaft extending from the jaw 12, to be described later, define a clamp assembly.

The threaded shaft 16 is supported in a spherical bearing 29 mounted in a support member 30 positioned on the outboard side of the cross member 20 and spaced therefrom. The spherical bearing 29 includes a sleeve 31 and a spherical bearing element 32 mounted for universal movement within the sleeve 31. The spherical bearing element 32 defines a bore 33 which is oversized relative to the threaded shaft 16 so that the threaded shaft 16 slides axially within the bore 33 when the moveable jaw 14 is moved toward or away from the fixed jaw 12. The threaded shaft 16 does not move axially when the vessel is moved conically, and the point where the threaded shaft 16 is supported in the spherical bearing element 32 corresponds to the vertex of the cone. The support member 30 is mounted in one end of a horizontally configured stand 34 comprising rod members 36. From the support member 30, the rod members 36 extend laterally outward and downward and then project horizontally for substantially the entire length of the mixing apparatus 10 to form support rails in engagement with a supporting surface. At the distal end, the rod members 36 extend laterally inward and upward in a converging manner to provide a support for parts, yet to be described, at the opposite end of the mixing apparatus 10. A hold down pad 38 projects horizontally from each support rail adjacent to the end of the mixing apparatus 10 in which the support member 30 is mounted so that the mixing apparatus 10 can be held stationary on a supporting surface, such as a table. A C-clamp can be used to engage each pad 38 to hold the mixing apparatus 10 down on a table. The hold down pads 38 can be provided with openings to receive screws as an alternate way of securing the mixing apparatus 10. No holddown pads are needed at the opposite end of the support rails.

Tension spring devices, such as helical coil tension springs 39, are connected between the horizontally projecting portions of the rod members 36 and portions of the cross member 20 laterally inside of the hand grips to resiliently prevent rotation of the cross member about the axis of the threaded shaft 16. As a result, the springs 39 also prevent rotation of the jaws 12 and 14, the guide bars 22, and the vessel relative to the stand 34, and keep the threaded shaft 16 from moving up and down within the clearance of the spherical bearing element 32. The choice of the springs 39 is heavily dependent upon the mass of the clamp assembly with a 1 gallon can of paint clamped in place and the operating speed of the mixing apparatus 10. The springs 39 must be strong enough to hold the threaded shaft 16 at the bottom of the oversized bore of the spherical bearing element 32 under dynamic loading in order to prevent slapping of the threaded shaft within the clearance. However, too strong a spring can cause the mixing apparatus 10 to pass through a destructive resonant condition upon startup. Proper selection of the springs 39 can minimize the resonant condition during startup. It has been found that springs having the minimum spring pressure required to prevent slapping of the threaded shaft 16 work well. When the springs 39 are chosen on the basis of a 1 gallon can of paint clamped in the clamp assembly, they will work properly as well for any smaller container clamped in the clamp assembly.

Figure 4:
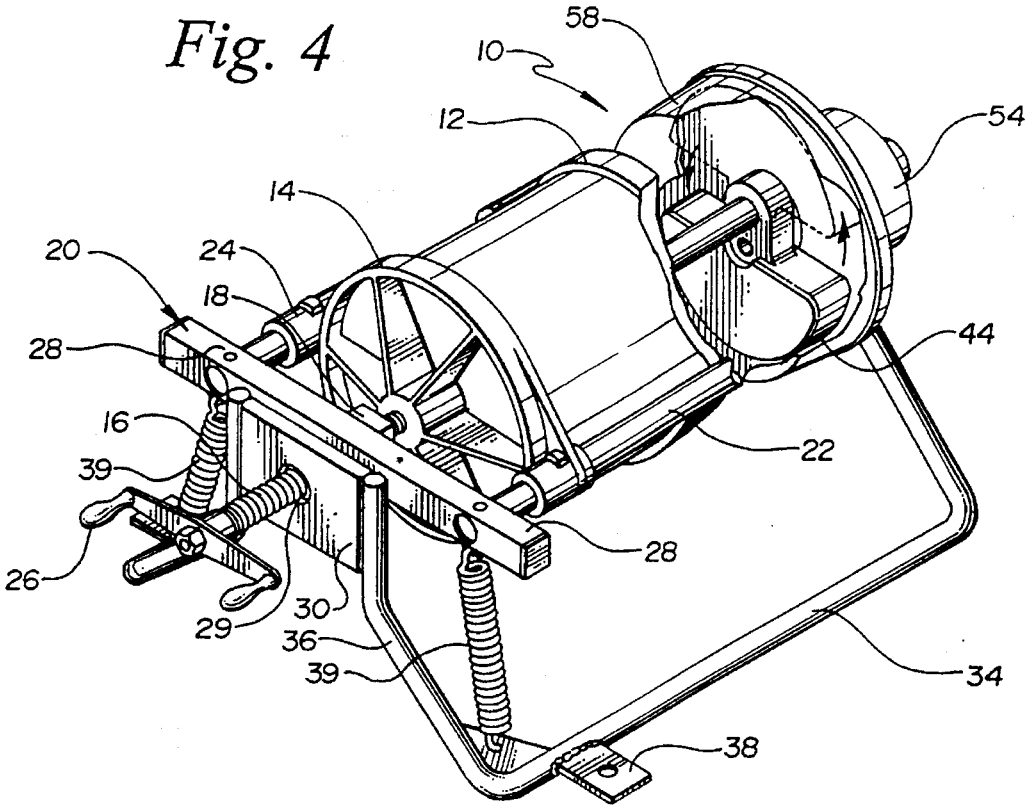
FIG. 4 is a perspective view of the mixing apparatus according to the present invention.
Figure 7:
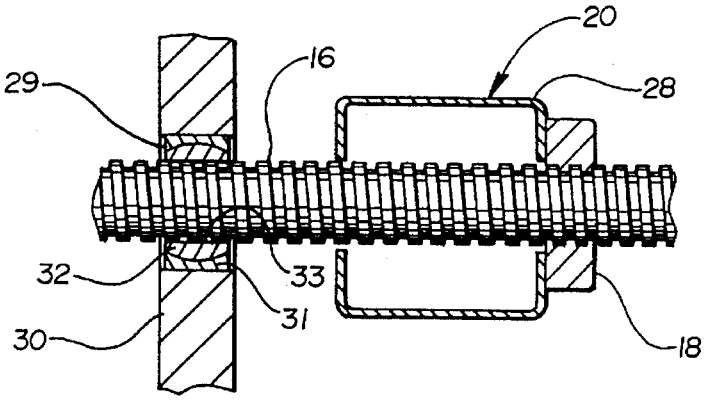
FIG. 7 is a view, partially in section as viewed along the section line 7—7 of FIG. 6.
Figure 5:
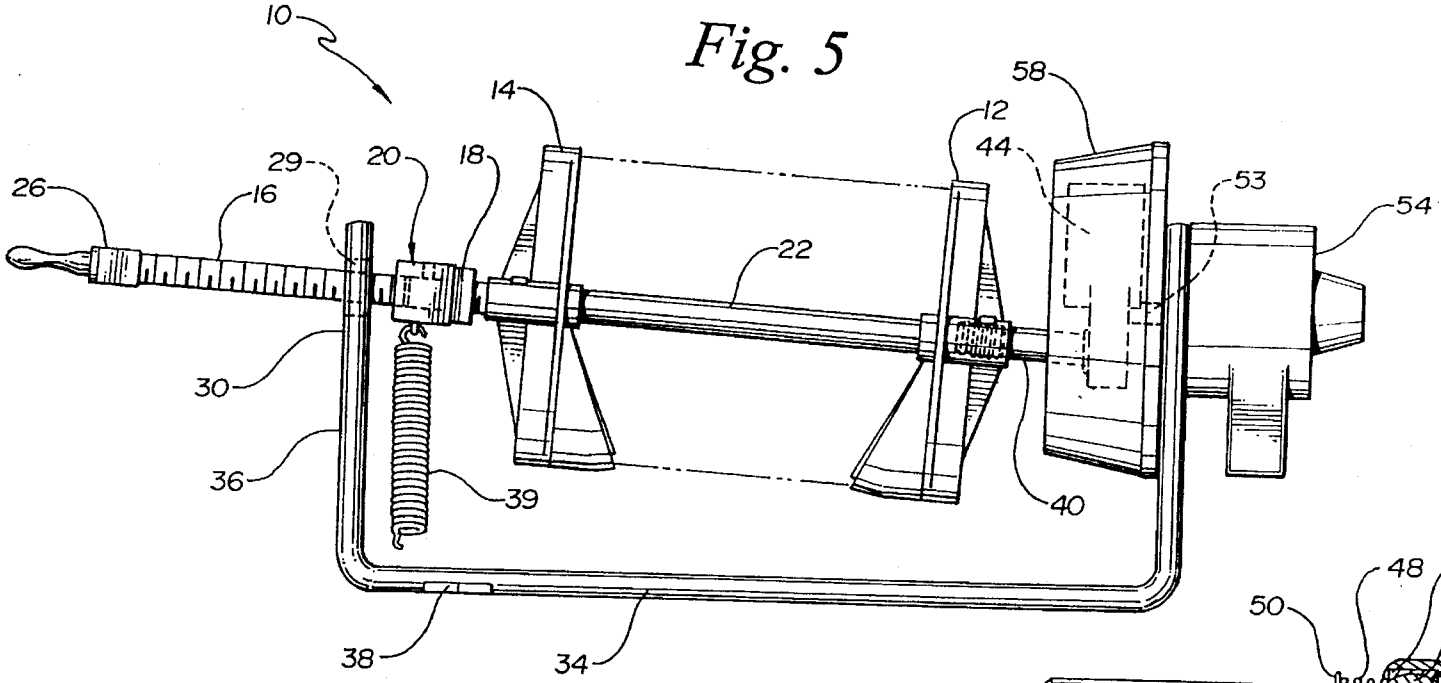
FIG. 5 is a side elevation of the mixing apparatus of FIG. 4.
Figure 8:
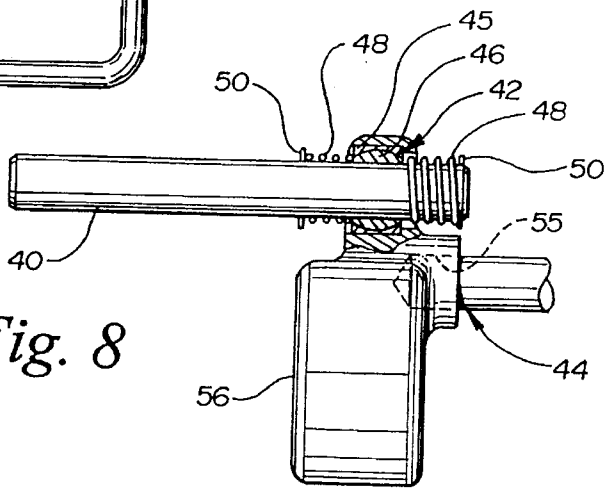
FIG. 8 is an enlarged view with portions broken away of the counterweight and spherical bearing of the mixing apparatus of FIG. 4.
Figure 6:
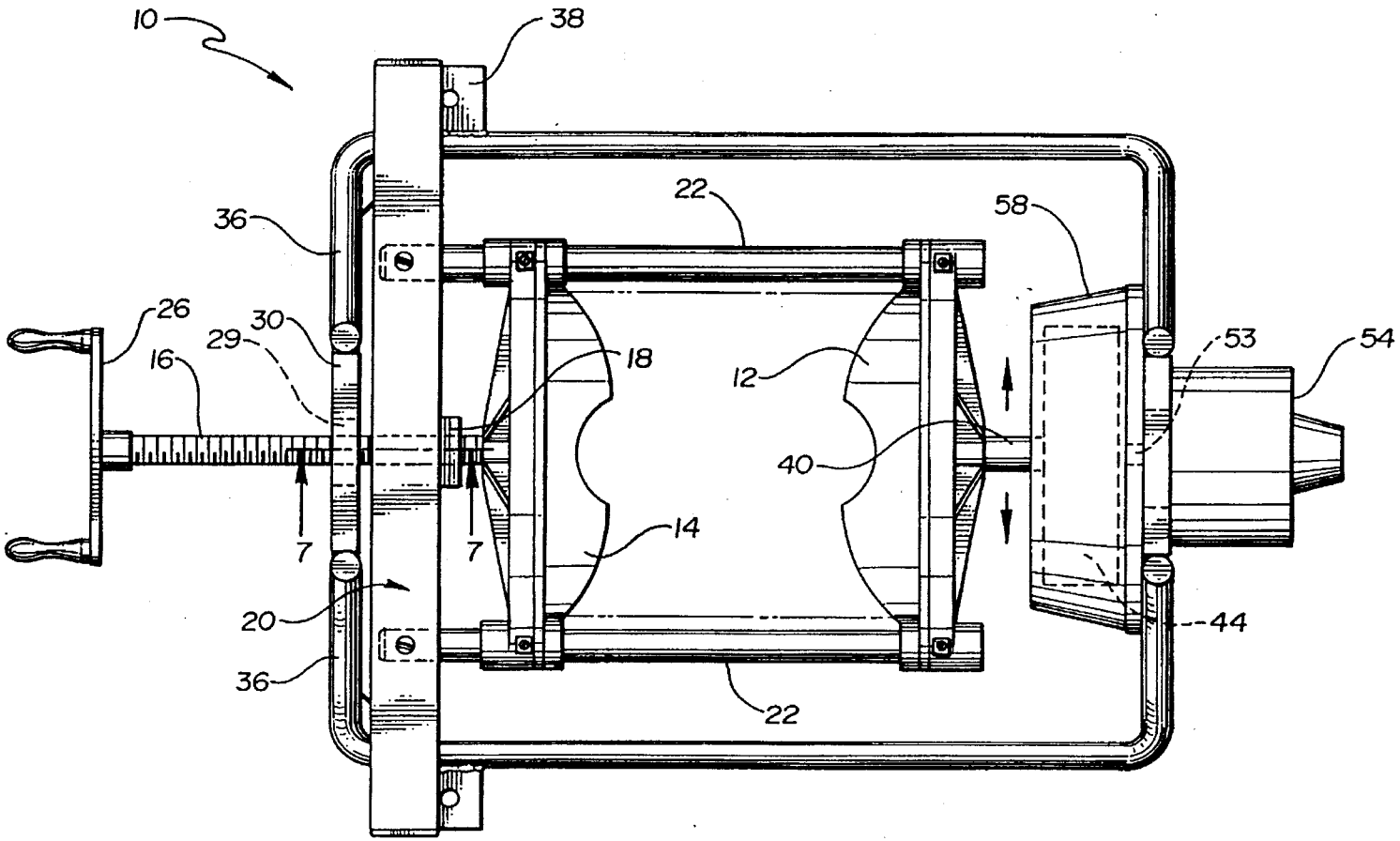
FIG. 6 is an elevational plan view of the mixing apparatus of FIG. 4.

A shaft 40 extends from the center of the fixed jaw 12 in an outboard direction toward the adjacent end of the mixing apparatus 10. As can be best be seen in FIG. 8, the shaft 40 is received in a spherical bearing 42 mounted in a portion of a rotating member 44. The spherical bearing 42 includes a sleeve 45 fixed in the rotating member 44 and a spherical bearing element 46 mounted for rotational movement in any direction within the sleeve 45. The shaft 40 extends through and beyond the spherical bearing element 46, and compression springs 48 are mounted around the shaft 40 on opposite sides of the spherical bearing element 46 and held in place by snap rings 50 which allow limited linear movement of the shaft 40 but bias the shaft to a predetermined position. The shaft 40 is prevented from rotating within the spherical bearing element 46 by frictional engagement with the springs 48 which are compressed between the snap rings 50 and the spherical bearing element 46. The rotating member 44 further includes a bore 52 for receiving the shaft 53 of a motor 54 (FIGS. 4 and 5). A counterweight 56 is an integral part of the rotating member 44 and extends radially from the rotating member on a side of the bore 52 opposite to the spherical bearing 42. The counterweight 56 is weighted to approximately balance the combined moment of the clamping assembly and the heaviest vessel likely to be clamped. This not only provides balance but also allows the motor 54 to start from dead stop with a minimum of starting torque. An annular guard 58 is positioned around the rotating member 44 for safety.

The motor 54 is preferably an air motor whose output shaft 53 is rotary. An air motor permits use of the mixing apparatus 10 in explosive environments.

Air motors are typically high speed devices which utilize power transmission components to tailor the speed of the driven member. They generally emit a loud, howling whine which is undesirable in working environments. When used in connection with the mixing apparatus 10, the air motor is caused to rotate at a speed which, for it, is very slow, that is, 500 to 550 rpm. This is accomplished by the use of a restrictive orifice (not shown) which drops the air pressure to the air motor to a value of less than 20 psi. The restrictive orifice is placed in the air supply line at the inlet to the air motor, and a blowoff valve is provided upstream to vent excess air in the event that too much air pressure is accidentally provided. A restrictive orifice having a diameter of 0.062" has been found to be suitable. This arrangement accommodates the more realistic compressed air pressures found in industrial environments, that is, pressures in the range of 60 to 100 psi.

The restrictive orifice and the blowoff valve are preferably arranged on a tee fitting. The restrictive orifice is arranged on one of the branches of the tee fitting, the branch which is secured to the inlet of the air motor. The blowoff valve is secured to another of the branches of the fitting, and the final branch has a quick-connect fitting for connection to a source of compressed air.

A wide range of modifications and substitutions can be made without departing from the spirit and scope of the present invention. For example, an electric motor, a hydraulic motor or other motor can be used instead of an air powered motor. Any motor can operate at higher speeds, if appropriate gearing is used to bring down the rotational speeds in the mixing apparatus according to the present invention. Such a gearing arrangement may be necessary if the invention is scaled up to be used with five gallon cans or 55 gallon drums. Alternate clamping arrangements can be employed, such as over center devices, air actuated pistons, gear trains, etc. Alternate clamping arrangements might be required if the invention is scaled up to be used with larger containers. The machine can be modified to eliminate the need to attach it to a supporting surface, and may be isolated by a motion absorbing device or assembly. A clamp may be provided so as to accommodate the clamped vessel in various orientations relative to the mixing apparatus. Components of elastomeric material may be substituted for the springs. A combination rubber/metal flexible retainer can be substituted for the spherical bearing at the fixed end. Although the mixing apparatus has been described in connection with the mixing of paint and other liquids, it can be used in connection with other mixing and agitating applications, such as the deburring of parts or polishing operations.

In the conical mixing apparatus described above, a clamp assembly is provided for clamping or holding a container of the material to be mixed. In the preferred embodiment, this clamp assembly includes a fixed jaw 12 adjacent to the drive means and a movable jaw 14 spaced from the fixed jaw. Jaw support means in the form of the guide bars 22 are provided for supporting the jaws 12 and 14 and facilitating relative movement toward and away from one another. A force resisting means in the form crossbar 20 is connected with the guide bars 22 for facilitating clamping force between the fixed and movable jaws. Preferably the guide bars and the crossbar will be rigidly connected with one another and can be a single unitary structure. The clamp assembly also includes clamp engagement means for moving the moveable jaw 14 into and out of clamping engagement relative to the fixed jaw 12. In the preferred embodiment this clamp engagement means is the threaded rod 16. The rod 16 is connected to and extends from the moveable jaw 14 where it is threadedly received by the force resisting means 20. The rod 16 then continues to extend through a frame portion of the apparatus where it is supported substantially at the vertex of the conical motion. This also corresponds to the point of intersection between the axis of the cone defined by the conical motion and the axis of rotation of the clamp assembly, and thus the container. The cone includes a proximal end adjacent to the drive means and a distal end defined by the cone's vertex.

Although the preferred embodiment contemplates a threaded rod with a crank as the mechanism for moving the jaw 14 into and out of clamping engagement, other mechanisms are also possible. For example, a short, unthreaded shaft can be provided between the crossbar 20 and the support member 30, with a separate clamp mechanism provided between the crossbar 20 and the moveable jaw 14.

In the above structure, the entire clamp assembly, except for the portion of the rod extending from the crossbar 20 is positioned to the drive means side of the vertex of the cone defining the conical motion. The clamp assembly is partially supported by a clamp assembly support and guide member supported at the cone vertex by a portion of the apparatus frame. In the preferred embodiment, the threaded rod 16, in addition to functioning as the mechanism for moving the jaw 14, also functions as this clamp assembly support and guide member.

Certain advantages of the apparatus of the present invention can be realized by various configurations and orientations. For example, although the preferred embodiment shows the apparatus in a horizontal orientation which, it is believed, leads to improved mixing, certain advantages can also be achieved by a vertical orientation of the present apparatus.

Accordingly, although the description of the preferred embodiment has been quite specific, it is contemplated that various modifications could be made without deviating from the spirit of the present invention. Thus, it is intended that the scope of the present invention be dictated by the appended claims rather than by the description of the preferred embodiment.

I claim:

1. Mixing apparatus for mixing a medium in a vessel comprising:

releasable fixing means for releasably fixing the vessel to the apparatus;

drive means connected to said releasable fixing means for moving the vessel in a path defining a cone;

the releasable fixing means further including a shaft extending to the vertex of the cone; and fixed supporting means for supporting said releasable fixing means and said drive means wherein said supporting means further includes means for supporting said shaft at the vertex of said cone.

2. The mixing apparatus of claim 1, wherein said vessel includes an axis and said releasable fixing means comprises means for preventing rotation of the vessel about the axis of the vessel.

3. The mixing apparatus of claim 1, wherein said vessel includes an axis and said releasable fixing means comprises means for fixing the vessel relative to the drive means such that the axis of the vessel generally coincides with the generatrix of the cone.

4. The mixing apparatus of claim 1, wherein said drive means comprises means for moving the vessel in a path defining a right circular cone having a generatrix of constant length.

5. The mixing apparatus of claim 1, wherein said releasable fixing means comprises two jaws for clamping the vessel, and said shaft being threaded and having an axis, said shaft being connected to one of the jaws for moving said one jaw relative to the other jaw.

6. The mixing apparatus of claim 5, wherein said releasable fixing means further comprises at least one guide member extending between said jaws in a direction substantially parallel to the generatrix of the cone, one of said jaws being mounted for sliding movement on said guide member.

7. The mixing apparatus of claim 6, wherein said releasable fixing means further comprises a cross member having a threaded bore threadedly receiving the threaded shaft, said at least one guide member being fixed to said cross member whereby said cross member defines a reaction member against which the threaded shaft reacts to hold one of the jaws in clamping engagement with the vessel.

8. The mixing apparatus according to claim 7, further comprising spring means for resiliently preventing rotation of the cross member about the axis of the threaded shaft.

9. The mixing apparatus of claim 5, wherein said supporting means comprises a spherical bearing, said threaded shaft being slidably received in said spherical bearing for sliding along the axis of said threaded shaft.

10. The mixing apparatus according to claim 1, wherein said supporting means comprises a stand having members extending down and laterally outward relative to said releasable fixing means.

11. The mixing apparatus according to claim 1, wherein said releasable fixing means comprises a second shaft, and said drive means comprises a motor having a rotary output shaft and a member extending radially from said rotary output shaft and connecting said rotary output shaft to said second shaft at a point radially spaced from said rotary output shaft.

12. The mixing apparatus according to claim 11, wherein said rotary output shaft includes an axis of rotation and said releasable fixing means has a member supported by said supporting means at a point along a line defined by the axis of the rotary output shaft.

13. The mixing apparatus according to claim 11, wherein said drive means further comprises a spherical bearing connecting said radially extending member to said second shaft.

14. The mixing apparatus according to claim 11, wherein said radially extending member includes a counterweight positioned on a side of said rotary output shaft opposite to said second shaft.

15. The mixing apparatus according to claim 11, further comprising an annular guard positioned around said radially extending member.

16. The mixing apparatus according to claim 11, wherein said motor is a pneumatic motor.

17. The mixing apparatus of claim 1 wherein said shaft extends beyond the vertex of said cone.

18. A mixing apparatus for mixing a medium in a container comprising:

a fixed apparatus support means;

a clamp assembly comprising clamp means for releasably retaining the container;

drive means connected to said support means and said clamp means for moving said clamp means and thus the container, in a path defining a cone, said cone having a proximal end adjacent to said drive means and a distal end defined by the vertex of said cone, said clamp means including a shaft extending to the vertex of said cone and said support means including means for supporting said shaft at the vertex of said cone.

19. The mixing apparatus of claim 18 wherein said clamp means includes a pair of container engaging jaws, jaw support means for supporting said jaws and facilitating relative movement of said jaws and clamp force resisting means for facilitating application of a clamping force to one of said jaws.

20. The mixing apparatus of claim 18 wherein said cone is substantially horizontal.

21. The mixing apparatus of claim 18 wherein said shaft is a threaded rod threadedly received by a portion of said clamp means.

22. The mixing apparatus of claim 18 wherein said shaft extends beyond the vertex of said cone.

23. The mixing apparatus of claim 18 wherein said means for supporting said shaft is spherical bearing.

* * * * *